US005408393A

United States Patent [19]

Becker

[11] Patent Number: 5,408,393

[45] Date of Patent: Apr. 18, 1995

[54] U-SHAPED HELMET LIGHT

[76] Inventor: Kenneth Becker, 6365 E. Peaks Pkwy., Flagstaff, Ariz. 86004

[21] Appl. No.: 158,750

[22] Filed: Nov. 26, 1993

[51] Int. Cl.[6] ..... F21L 15/14

[52] U.S. Cl. ..... 362/105; 362/184; 362/249

[58] Field of Search ..... 362/103, 105, 106, 249, 362/251, 252, 184, 157; 2/5, 209.2

[56] References Cited

U.S. PATENT DOCUMENTS

| | | | |
|---|---|---|---|
| 994,094 | 5/1911 | Eaton . | |
| 3,350,552 | 10/1967 | Lawrence | 362/105 |
| 3,634,676 | 1/1972 | Castellano | 362/105 |
| 4,234,910 | 11/1980 | Price | 362/105 |
| 4,616,297 | 10/1986 | Liu | 362/105 |
| 4,891,736 | 1/1990 | Gouda | 362/105 |
| 4,999,747 | 3/1991 | Chen . | |
| 5,224,772 | 7/1993 | Fustos | 362/103 |

FOREIGN PATENT DOCUMENTS

| | | | |
|---|---|---|---|
| 717321 | 10/1931 | France | 362/105 |

*Primary Examiner*—Richard R. Cole

[57] ABSTRACT

An improved head lamp assembly adapted for use on protective helmets and other headgear, comprises a "U"-shaped housing, multiple head lamps supported by the housing and arranged to project multiple overlapping cone shaped light beams in a direction generally parallel to the plane of the "U", each head lamp including a light bulb and a reflector for shaping the individual cones of illumination, wherein the head lamps are spaced apart along a front face of the "U"-shaped housing so as to project overlapping cones of illumination in a direction parallel to the plane of the "U" and having a total included lateral angle of illumination approaching that of human peripheral vision. The assembly contains batteries for powering the multiple head lamps, an interconnecting circuit, on/off switch and power supply and charger connections. The U-Shaped housing is substantially rigid, desirably of rectangular cross-section and conveniently snaps into place on the protective helmet.

20 Claims, 3 Drawing Sheets

U-SHAPED HELMET LIGHT

FIELD OF THE INVENTION

The present invention relates to a light adapted to be attached to a helmet or other head gear, especially a protective helmet, to illuminate a wide region in front and partly to the side of the helmet user.

BACKGROUND OF THE INVENTION

Police, firemen, miners and other who are required to enter or work in areas of little or no ambient illumination must carry with them some form of artificial light in order to perform their work and avoid hazards. Battery operated electric lamps are commonly used for this purpose.

Such workers typically also use safety helmets to protect their heads from falling rocks, timbers, tools, debris and other objects. In order to leave the worker's hands free, it is desirable to attach a battery operated electric torch to the protective helmet so that it shines forward in the direction in which the user faces when the helmet is worn in its normal position. A miner's lamp is a familiar example, in which an electric torch in the form of a head lamp a few inches in diameter and having a bulb and reflector is mounted on or in the forward portion of the miner's protective helmet and powered by a rechargeable battery pack generally attached to the miner's belt or coat. An electric wire connects the head lamp to the battery pack. A switch is provided to allow the head lamp to be turned on or off as the user desires. Such head lamp arrangements are well known and have been adapted to helmets worn by firemen, policemen, emergency rescue personnel and others who must work in dark places and have their hands free. A version for use by a fireman is shown in U.S. Pat. 994,094 which is incorporated herein by reference.

While prior an versions of helmet mounted head lamps are useful, they suffer from a number of disadvantages. For example, the area of illumination is typically limited to a cone shaped region directly in front of the user which is narrower than the typical person's field of view. Under these circumstances hazardous objects at the periphery of a person's vision are not illuminated by the head lamp, thus exposing the user to unexpected injury from objects outside of the comparatively small illuminated area or requiring the user to constantly move his or her head from side to side and up and down to sequentially illuminate adjacent regions. A second problem with present day helmet mounted head lamps is that they often interfere with a protective face mask attached to the user's helmet. For example, the head lamp prevents the protective mask from being raised out of the way if it becomes damaged or interferes with the user's ability to help a victim (e.g., when mouth to mouth resuscitation is needed). Under these circumstances, the user may need to remove the helmet or tip it back out of the way, thereby increasing his or her own risk of injury because its protective function has been compromised.

Thus, a need continues to exist for an improved head lamp for use on safety helmets or other head gear and which illuminates a region approaching the extent of the human eye's peripheral vision, which does not interfere with retraction and/or use of a protective face mask, and/or which does not create a protrusion which is easily snagged by foreign objects the user may encounter.

SUMMARY OF THE INVENTION

The foregoing and other limitation of the prior art are overcome by an improved head lamp adapted for use on protective helmets and other headgear, the improved head lamp comprising, a curved (e.g., "U"-shaped) housing, multiple head lamps supported by the housing, each head lamp including a light bulb and a reflector for forming individual illumination cones, wherein the head lamps are spaced apart along a front face of the housing to project overlapping individual cones of illumination at different angles, means for receiving one or more batteries for powering the multiple head lamps, and circuit means for connecting the one or more batteries and the multiple head lamps. It is desirable that the light bulbs are of a type producing substantially white light. The combination of overlapping cones of illumination produced by the spaced apart and angled head lamps illuminates a region approaching the extent of human peripheral vision. In a preferred embodiment, the housing is substantially rigid and approximately of a rectangular cross-section.

DETAILED DESCRIPTION OF THE PREFERRED EMBODIMENT

Figure 1:
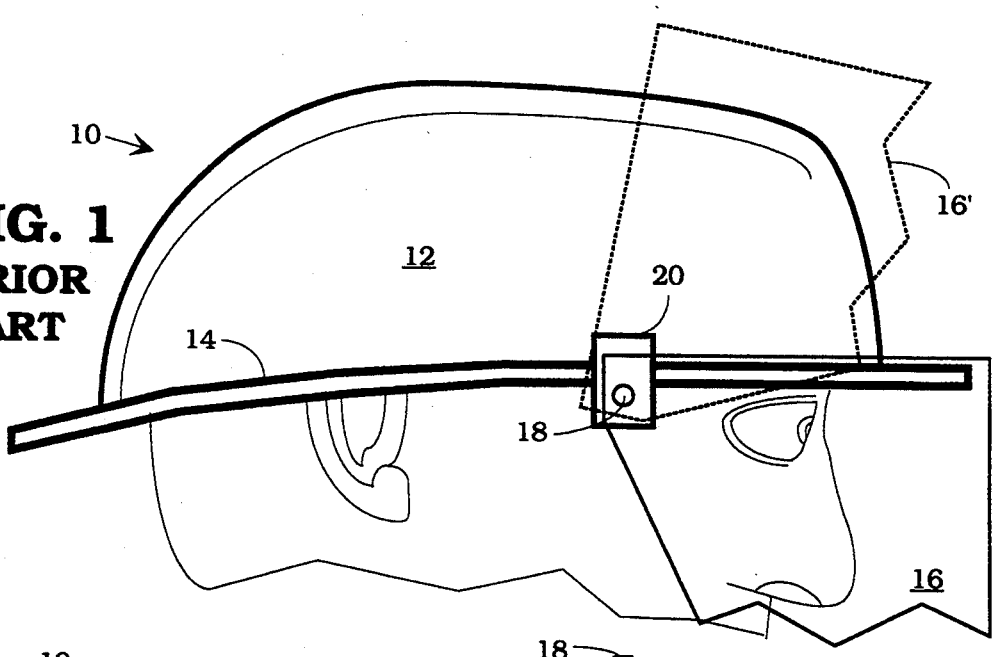
FIG. 1 PRIOR ART
FIG. 1 shows a side view, FIG. 2 a top view and FIG. 3 a front view of a conventional protective helmet with a retractable face guard, such as is typically used firemen and other public safety and rescue personnel.
Figure 2:
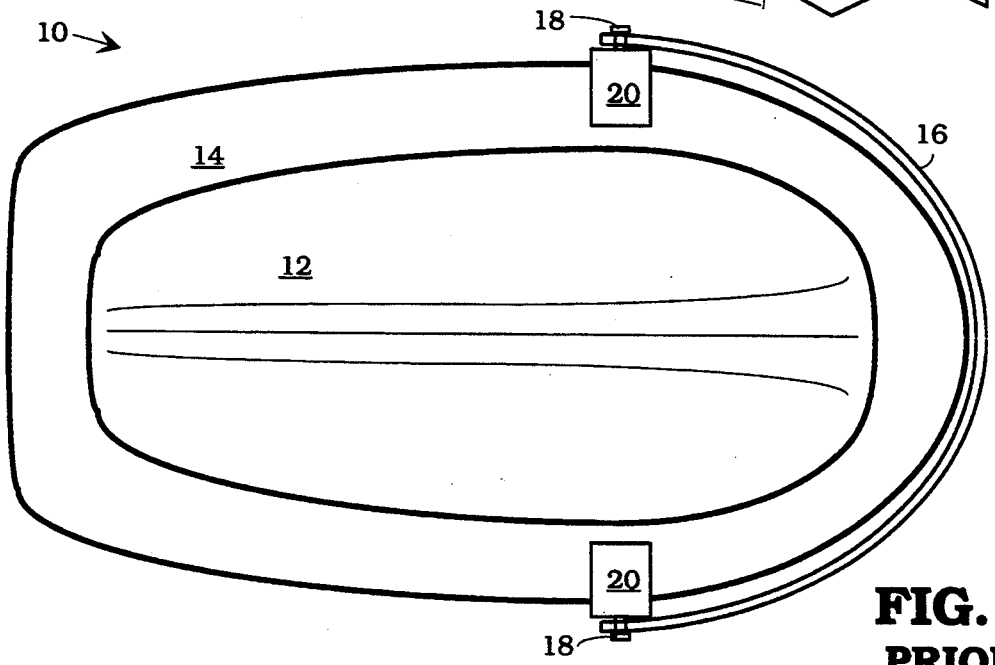
FIG. 2 PRIOR ART
Figure 3:
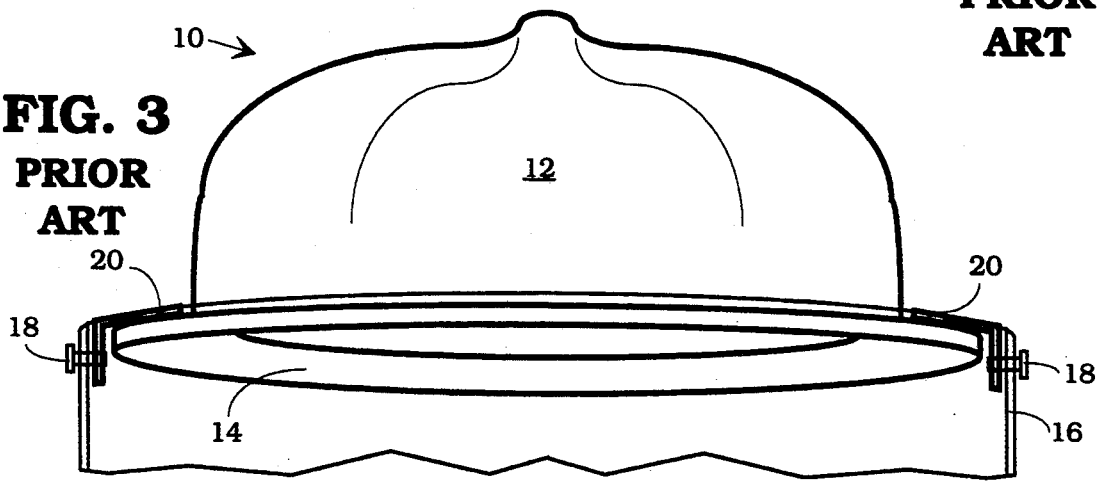
FIG. 3 PRIOR ART

FIG. 1 shows a side view of protective helmet 10, FIG. 2 a top view of helmet 10 and FIG. 3 a front view of helmet 10. Helmet 10 comprises crown portion 12 and brim portion 14. Helmet 10 has retractable face guard 16 which is attached to helmet 10 by pivots 18 and brackets 20. FIG. 1 illustrates how face guard 16 may be raised as shown by dotted line 16'. Helmet 10 and face guard 16 are conventional. Face guard 16 swings on pivots 18 attached to helmet 10 by brackets 20.

Figure 4:
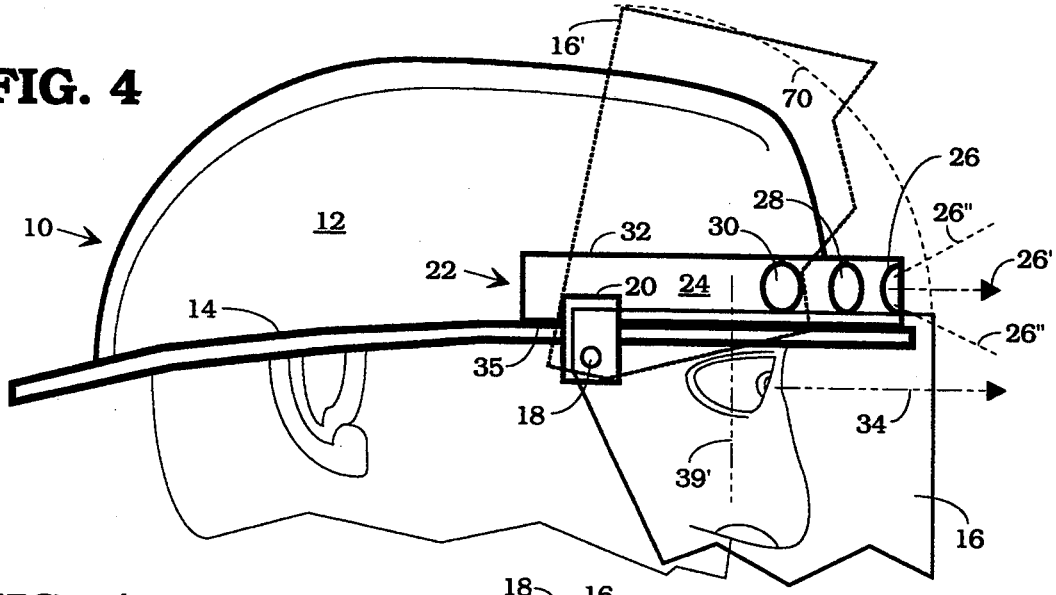
FIGS. 4–6 are views similar to FIGS. 1–3, but with a curved and generally U-shaped head lamp assembly, according to the present invention mounted on the helmet.
Figure 5:
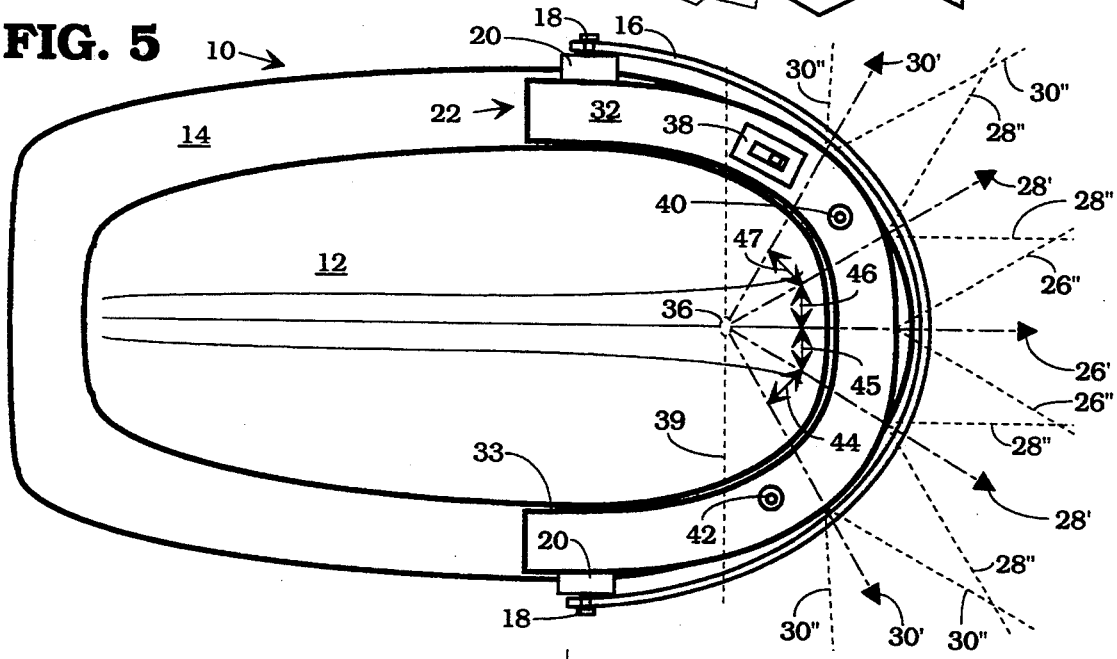
Figure 6:
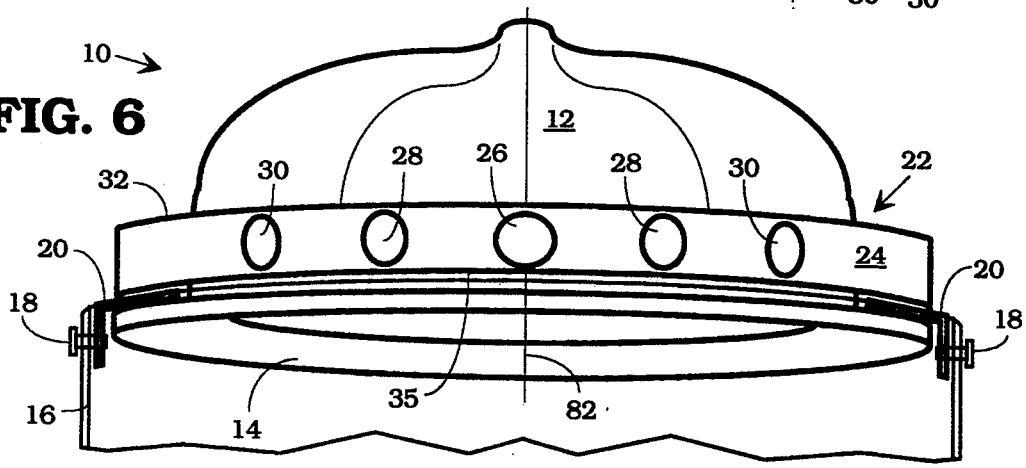

FIGS. 4–6 are views similar to FIGS. 1–3, but with curved head lamp assembly 22 according to the present invention mounted on helmet 10. Head lamp assembly 22 is generally U-shaped and has housing 23 with front face 24 in which are exposed head lamps 26, 28, 30 producing, respectively, light beams having central axes denoted by arrows 26', 28', 30'. Housing 23 has a generally rectangular cross-section and substantially flat upper surface 32 (see FIG. 9). When head lamp assembly 22 is mounted on helmet 10 with helmet 10 worn in the conventional manner by user 33, then the cones of illumination 26", 28", 30" of the light beams with central axes 26', 28', 30', are in the direction of the user's general forward line of sight indicated by arrow 34 but with a lateral extent desirably approaching the lateral extent of human peripheral vision.

As used herein the word "lateral" is intended to refer to the direction or angles on either side of axis 26' that lie in a plane substantially parallel to the plane formed by the "U"-shaped arms of assembly 22 (i.e., the principal plane of assembly 22). As used herein, the words "horizontal" and "vertical" are intended to refer to directions or planes referenced to assembly 22, i.e., "horizontal" means that direction or plane lying parallel to the principal plane of assembly 22 and "vertical" means that direction or plane lying perpendicular thereto. Thus, "vertical" is parallel to line 82 in FIG. 6. The user may tilt helmet 10 and assembly 22 at many different angles with respect to the Found with a corresponding reorientation of the "horizontal" and "vertical" directions defined herein since they are referenced to the principal plane of assembly 22.

Axis arrows 26', 28' 30' when extended behind head lamps 26, 28, 30 desirably intersect approximately in region 36 within the arms of assembly 22, but this is not essential. For example, some head lamps may have their axes angled slightly up or down (e.g. in the vertical direction) with respect to the others as well as being angled apart in the lateral (e.g., in the horizontal) direction. Region 36 desirably approximately intersects plane 39 passing through the eyes of user 33 when assembly 22 is mounted on helmet 10 for normal use, but that is not essential. Power connections 40, 42 and switch 38 are provided for supplying electrical power and turning head lamps 26, 28, 30 on and off.

While head lamp assembly 22 and housing 23 are shown as containing five head lamps, 26, 28, 28, 30, 30 (which is preferred), more or fewer head lamps may be user. However, what is important is that cones of illumination 26", 28" and 30" produced by head lamps 26, 28, 30 have a total lateral included angle 80 (see FIG. 7) which is at least about 160 degrees and preferably at least about 170 degrees and even as much as 180 degrees or more. There is little need for the lateral included angle of illumination to significantly exceed the total lateral angle of human peripheral vision which, for many people, is typically in the range of about 180±10 degrees with the head and eyes stationary. In the preferred embodiment using five head lamps, adequate lateral illumination is accomplished by having angles 44–47 between central axes 26', 28', 30' of cones of illumination 26", 28", 30" in the range of 15 to 30 degrees, with about 20–25 degrees being convenient and about 22–23 degrees being preferred. Cones of illumination 26", 28", 30" may be rotationally symmetric about axes 26', 28', 30' or may be asymmetric, as for example, having an angular width in the lateral direction that is different than their angular width in the vertical direction. As used herein the words "cone of illumination" or "illumination cone", singular or plural, are intended to encompass either symmetric or asymmetric cones of illumination or a combination thereof..

Figure 7:
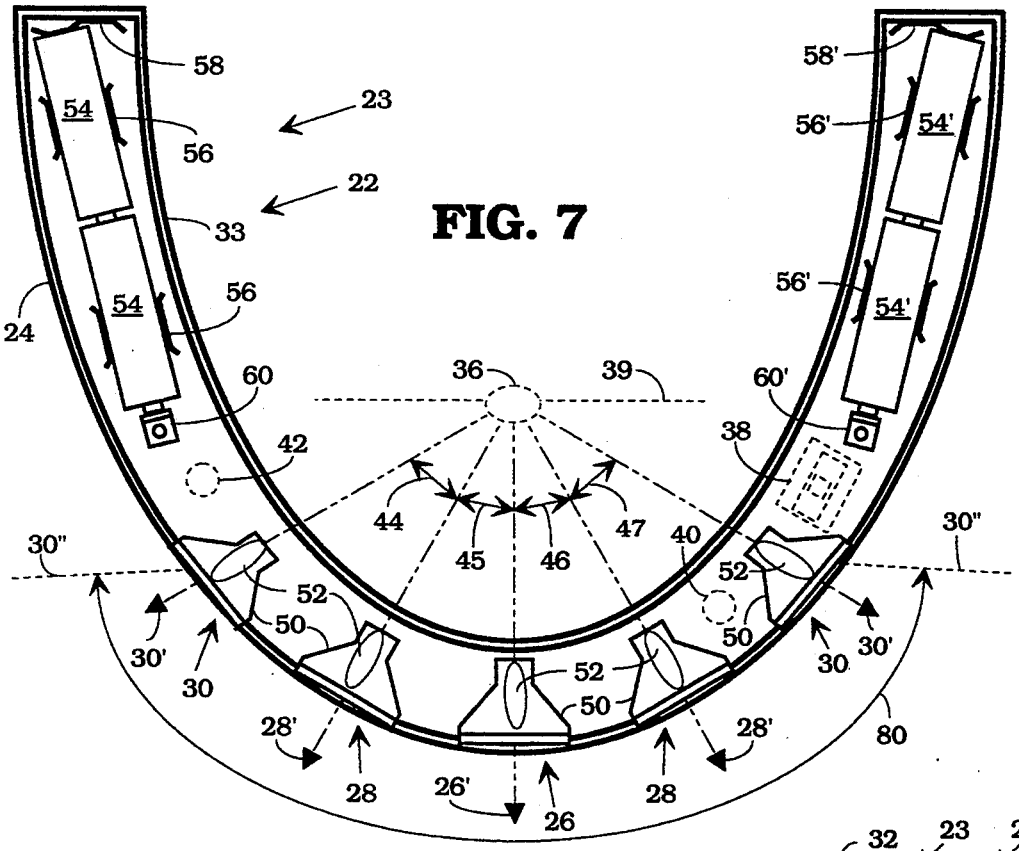
FIG. 7 is a top view of the assembly of the present invention somewhat enlarged and with the upper surface removed to show more details of the internal construction.

FIG. 7 is a top view of head lamp assembly 22 of the present invention somewhat enlarged and with upper surface 32 removed to show more details of the internal construction of head lamp assembly 22. The principal plane of head lamp assembly 22 is substantially parallel to surface 32.

Front surface 24 is pierced to allow light from head lamps 26, 28, 30 to project forward and to the side as illustrated by illumination cones 26", 28" 30". In the preferred embodiment, head lamps 26, 28, 30 are identical. Each has reflector 50 and bulb 52. While having head lamps 26, 28, 30 the same is preferable for simplicity of manufacture, this is not essential and different head lamps may be used in each position. However, it is desirable that they be used in pairs, that is that head lamps 28 be identical and head lamps 30 be identical. In this way the illumination provided by assembly 22 is generally symmetrical about vertical plane (or line) of symmetry 82 (see FIG. 6) oriented in a fore-aft direction and passing through the center of the "U" half-way between the arms. Axis 26' lies in this plane of symmetry Referring now to FIGS. 8A–B, assembly 22 is conveniently held in place on helmet 10 by spring clips 25 or 27 or a combination thereof. Spring clips 25, 27 are conveniently attached to crown 12 or brim 14 of helmet 10 by rivets (not shown) and have lips 29 which extend over assembly 22 to prevent it from sliding off helmet 10. Spring clips 27 are conveniently attached to helmet 22 in the vicinity of brackets 20 on either side of crown 12 in locations so as to not interfere with pivots 18. Spring clip 25 is generally desirably attached on a forward portion of helmet 22, as for example, in the vicinity of head lamp 26 and with lip 29 small enough so as not to interfere with the light being emitted from head lamp 26. When clip 25 is used, then it is sufficient to merely provide short rectangular sleeves (or equivalent) in the vicinity of brackets 20 to retain the ends of the arms of U-shaped assembly 22 when its central portion is slipped into clip 25 located on the forward portion of helmet 10. Either or both types of clips may be used. While this arrangement for removably attaching assembly 22 to helmet 10 is preferred other means of attachment may also be used. Non-limiting examples are, Velcro TM like materials, or spring-loaded protrusions provided in crown 12 of helmet 10 approximately in the vicinity of brackets 20 which engage detents (i.e., depressions) in inner surface 33 of housing 23 when it is slid into position on helmet 10, or vice-versa (i.e., protrusions in housing 23 and detents in helmet 10).

Figure 9:
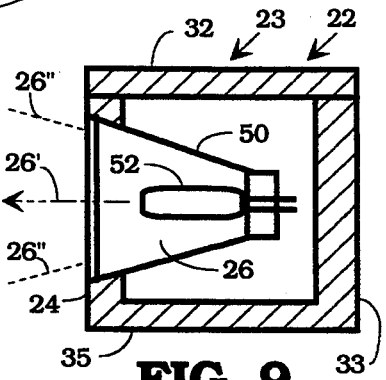
FIG. 9 shows a simplified partial cross-sectional view of the head lamp assembly of the present invention, including a reflector and bulb head lamp combination.
Figure 8B:
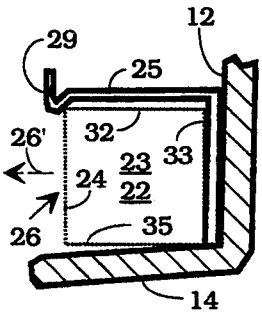
FIGS. 8A–B show various means for attaching the head lamp assembly of the present invention to the helmet.
Figure 8A:
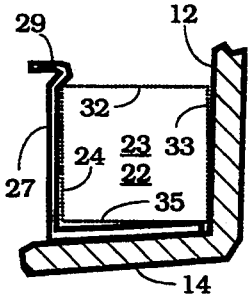

Batteries 54, 54' are conveniently held by conventional battery retention clips 56, 56' provided in housing 23 of assembly 22, but this is not essential. Any means of retaining batteries 54, 54' consistent with the available space within housing 23 may be used. Housing 23 is desirably of rectangular cross-section as is illustrated in FIGS. 8A–B and 9. Contacts 58, 58' and 60, 60' are provided in housing 23 of assembly 22 to make electrical connection to batteries 54, 54'. Switch 38 and power supply connections 40, 42 are preferable located in top 32 of housing 23. Top 32 is omitted in FIG. 7 for clarity but the approximate locations of connections 40, 42 and switch 38 are shown by dashed outlines. The electrical wiring necessary to couple batteries 54, 54', switch 38, power supply connections 40, 42 and bulbs 52 are omitted in FIG. 7 to avoid confusion.

FIG. 9 shows a simplified partial cross-section through assembly 22 and housing 23 in the vicinity of head lamp 26. For convenience, head lamp 26 comprising reflector 50 and bulb 52 is shown in FIG. 9 in schematic form, since the exact shape and arrangement thereof will depend upon the particular combination chosen. Persons of skill in the art understand that reflectors typically use curved reflective inner surfaces with a curvature that depends upon the type of bulb being employed, and where the relative position of the reflector and bulb vary according to the light distribution desired.

Figure 10:
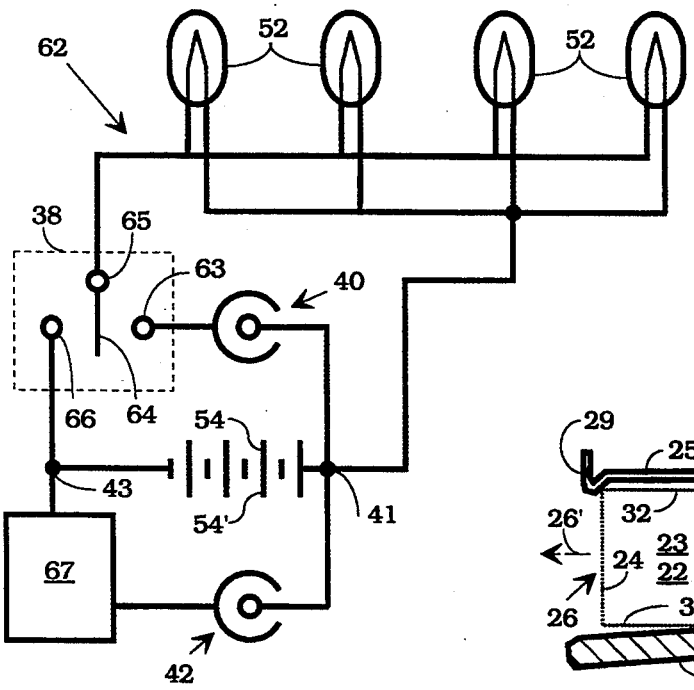
FIG. 10 shows a schematic of an electrical circuit of the head lamp assembly of the present invention according to a preferred embodiment.

FIG. 10 shows simplified electrical schematic 62 illustrating the electrical connections between bulbs 52, switch 38, power connections 40, 42 and batteries 54, 54' according to a preferred embodiment. By way of example, circuit 62 illustrates an arrangement in which bulbs 52 are connected in parallel and batteries 54, 54' are connected in series-parallel so as to be able to use 1.5 volt batteries to drive 3.0 volt bulbs. Power connections 40 and 42 are preferably conventional coaxial two wire connectors, but any type of connector consistent with the available space and current requirements may be used. Those of skill in the art will understand based on the description herein how to select optimal components from the many different types available.

Movable arm or armature 64 of switch 38, in one extreme position, conveniently makes contact to pole 63 of switch 38 which is coupled to one node of power supply connection 40, whose other node is coupled to junction 41 which is in turn connected to batteries 54, 54' and to one common lead of bulbs 52. Common pole 65 of switch 38 is connected to armature 64 and the other common lead of bulbs 52, thereby completing the circuit when an external energy source is attached to connection 40. Power connection 40 is intended for connection to an external battery, as for example, a belt-worn or air pack worn battery or other source of power, to provide energy to bulbs 52 for a longer period than might be possible on internal batteries 54, 54' alone.

Opposite pole 66 of switch 38 is contacted by armature 64 when armature 64 is in the opposite position and connected to junction 43, which is in turn connected to batteries 54, 54' and to regulator 67. The opposite terminal of regulator 67 is connected to a pole of power connection 42. Power connection 42 is intended for a power source suitable to recharge batteries 54, 54' when they are of the rechargeable type. Regulator 67 insures that batteries 54, 54' will not be overcharged. Such regulators are well known in the art and sold in various forms by numerous electronics manufacturers and distributors. Those of skill in the art will understand based on the description herein how to choose an appropriate regulator depending upon the batteries used, and how to modify circuit 62 to accommodate such variations. The opposite pole of power connection 42 is coupled to junction 41. As long as batteries 54, 54' are charged, lamps 52 lights up when switch 38 has armature 64 in contact with pole 66, whether or not there is a power source coupled to connection 42. When there is no power source coupled to connection 42, lamps 52 run on internal batteries 54, 54' and when there is an external power source coupled to connection 42, then lamps 52 run on such external power source provided that it supplies a voltage greater than that of batteries 54. 54'. This is generally the case for a source intended for battery charging. When switch 38 has armature 64 in a central position so that it is not in contact with either pole 63 or 66, then no power is supplied to bulbs 52 and they are off.

Referring again to FIG. 4, it can be seen that the compact form of head lamp assembly 22 permits visor or face guard 16 to be retraced into position 16' along arc 70 without interference from assembly 22. This is a particular feature of the present invention.

A further feature of the present invention is illustrated in FIGS. 5, 7, wherein it is apparent that cones of illumination 26'', 28'', 30'' provided by head lamps 26, 28, 30 separated by angles 44–47 can cover substantially the lateral entire field of vision 80 of the normal human eyes. This is a significant advantage. The peripheral illumination provided by assembly 22 allows the user to detect potential hazards approaching at the periphery of vision. With prior art systems which only provide a single, comparatively narrow, central cone of illumination directed forward of the user, the user must constantly move his or her head back and forth and up and down to provide illumination in regions otherwise outside this central cone. When the work at hand prevents this constant head motion, the user of prior art head lamp systems are less able to detect hazards approaching from outside the central cone of illumination. The present invention provides multiple overlapping cones of illumination having an expanse generally approximating the peripheral vision capabilities of the human eyes. Thus, approaching hazards can be more readily detected without such head motion since they are illuminated earlier in their approach.

A still further advantage of the present invention is that assembly 22 need not protrude beyond helmet brim 14 and therefore does not create any significant protrusions from helmet 10 that can snag on foreign objects contacted by the rescue worker's helmet. Accordingly, the head lamp assembly of the present invention contributes to substantially improved safety for rescue workers, firemen, miners and the like.

EXAMPLE

A head lamp assembly substantially as illustrated in FIGS. 4–7 and 9–10 was constructed of Lexan TM type plastic for housing 23 and lid 32. The spacing of the open ends of the curved portion (i.e., between the ends of the "U") was approximately 24 cm and the "U" had a depth from the open ends to inside surface 33 of the central portion of the "U" of approximately 17 cm. Housing 23 was approximately 2.6 cm thick from inside surface 33 to outside (front) surface 24, and 2.3 cm high from bottom surface 35 to top surface 32. The battery holders were attached by rivets or screws. Region 36 was located between the arms of the "U" approximately 10–11 cm behind inside surface 33 of housing 23. Power connections 40, 43 and switch 38 were retained by conventional nuts or clips. Measured along front face 24, the centers of head lamps 26, 28, 30 were about 4.5–5.5 cm apart and angles 44–47 were about 22–24 degrees. The housing had a curved, generally "U" shape which fit snugly around the forward pan of crown 12 of a standard fireman's helmet within the perimeter of brim 14. Virtually any shape helmet can be accommodated by altering the shape of the housing to fit. Because of its hollow-box construction, housing 23 was substantially rigid although not completely without spring. By making the "U" slightly undersized, it can be arranged to "grip" the helmet, but that is not essential.

Head lamps 26, 28, 30 were obtained by extracting the reflector and bulb assemblies from five miniature two-cell flashlights. MINI-MAGLITE® flashlights manufactured by Mag Instruments Corporation of Ontario, Calif. are a well known example of miniature flashlights which are commercially available and suitable. Reflector and bulb assemblies from miniature flashlights manufactured by others are also suitable. Miniature flashlights of this type generally use pin-lead type bulbs of various voltage ratings (e.g., 1.5 V or 3.0 v) depending upon the number of battery cells accommodated by the flashlight. These bulbs produce substantially white light of considerable intensity, that is, they are bright enough to allow a normal person to see quite well and perform substantial work within their cone of illumination in the absence of any other light source. They are much used as emergency lights by rescue workers in a great variety of situations and as target illuminating lights in connection with weapons. Low output lights such as conventional light emitting diodes (LED's) are useful for indicator lights (e.g., in electronic equipment to tell when a circuit is energized) and target designating lights for use with weapons (e.g., in laser sights), but they are generally not well suited for use in connection with the present invention because they typically cannot provide a broad cone of illumination of sufficient brightness to illuminate a rescue scene and they do not provide substantially white light.

Important considerations in selecting bulbs for use in the helmet light assembly of the present invention are: (i) small size, (ii) sufficient total brightness to provide a useful illumination level for rescues or emergencies or other types of work, (iii) portability, (iv) ruggedness, (v) substantially white light output color, (vi) and power consumption low enough to be used with reasonably small batteries and still have a battery life of an hour or more. The types of bulbs conventionally used in -miniature flashlights meet these criteria satisfactorily, but this does not preclude the use of other bulbs which are also able to satisfy these criteria and yield a size and weight combination for the bulbs, reflectors and batteries suitable for use on typical protective helmets or other head gear.

Nominally 3 volt, pin lead type bulb and reflector modules extracted from two-cell miniature flashlights were used for the test unit. These reflector- lamp assemblies are about 2 cm in diameter at the outboard end of the reflector. The normal cover window supplied over the reflector and bulb was retained to prevent damage to the reflector and bulb and to keep them clean. Depending upon the curvature of the reflector and positioning of the bulb, this window may be planar or curved to provide no focusing or additional focusing or defocusing, as may be needed to obtain the desired cone of illumination for each head lamp. Based on the description herein, those of skill in the an will understand how to select an appropriate reflector, bulb and protective window or lens combination to achieve the illumination cone angles and light distribution therein which are particularly desired. Head lamps 26, 28, 30 were conveniently cemented to housing 23 but any convenient means of mounting may also be used. While the above-described reflector and bulb assemblies were particularly useful and easy to obtain, other reflector and bulb assemblies commonly available in the industry are also suitable. In the test unit, axes 26',28' and 30' were substantially in a common plane parallel to the principal plane of assembly 22.

The above-described assembly with five head lamps from two-cell miniature flashlights and four conventional AA type alkaline batteries arranged 2/2 (i.e., two parallel pairs of two-cell series connected batteries providing 3 volts total), gave about 3–4 hours of useful illumination. The same arrangement but with 4-AA type rechargeable batteries gave about 2–3 hours of useful illumination. These durations are more than sufficient for use by emergency workers in typical rescue situations. If longer illumination is required, the invented helmet fight assembly can be slipped off the helmet and replaced with another having fully charged batteries in just a few second. The depleted batteries can then be replaced or recharged away from the immediate work scene in about the same time needed to replace or recharge the batteries of a conventional flashlight and the helmet light made fully operational once more. Important advantages of the present invention are (a) convenience of operation, (b) easy replacement, (b) comparatively small size adapted to fit closely on the protective helmet so as to not snag on foreign objects., (c) no interference with the movable protective face mask associated with the protective helmet, (d) rugged construction, (e) easy battery replacement or recharging and (f) overall brightness sufficient to perform rescue or other types of work in the absence of significant ambient illumination.

Having thus described the present invention, it will be apparent that the present invention provides an improved head lamp assembly for use on safety helmets or other head gear and which illuminates a region approaching or equaling the extent of the human eye's peripheral vision and which does not interfere with retraction and/or use of a protective face mask associated with the helmet or head gear. In addition, the present invention may be fabricated from light weight, inexpensive and durable commercially available materials and parts and is thus of low cost and rugged construction. These factors are also important and result in an especially practical and useful head lamp assembly. The overall illumination brightness is equal to that produced by multiple (e.g., five) miniature flashlights, which is highly desirable.

For purposes of explanation, the present invention has been described in terms of particular embodiments and arrangements. Based on the teachings herein, those of skill in the art will conceive of other arrangements, embodiments, alternatives and substitutes to achieve the substantially the same results in an equivalent manner. It is intended to include all such equivalents as fall within the scope of the claims that follow.

What is claimed is:

1. An assembly for providing hands-free illumination, comprising:

a housing having a "U" shape comprising first and second arms joined by a curved central portion, wherein the central portion has a curved outer front face and wherein the housing has a major axis lying approximately mid-way between the arms and bisecting the curved front face in an outward direction;

multiple head lamps supported by the housing, each head lamp including a light bulb and a reflector within the housing for forming individual illumination cones, wherein the multiple head lamps are spaced apart along the curved front face of the "U"-shaped housing to outwardly project overlapping individual cones of illumination at different angles with respect to the major axis to illuminate a working area before and toward the side of the user;

means for receiving one or more batteries for powering the multiple head lamps; and circuit means for connecting the one or more batteries and the multiple head lamps.

2. The assembly of claim 1 wherein the light bulbs are of a type producing substantially white light.

3. The assembly of claim 1 wherein beams of light produced by the multiple head lamps each have a central axis and wherein the head lamps are supported by the housing so that the central axes of the multiple head lamps lie substantially in a common plane parallel to a plane formed by the arms.

4. The assembly of claim 3 wherein there the central axis of each head lamp is separated from a central axis of an adjacent head lamp by an angle in the range of 15–30 degrees.

5. The assembly of claim 4 wherein there are an odd number greater than one of head lamps and the central axes of each head lamp is separated from a central axis of an adjacent head lamp by an angle in the range of 15–30 degrees.

6. The assembly of claim 1 wherein beams of light produced by the multiple head lamps each have a central axis and wherein the head lamps are supported by the housing so that the central axes of the multiple head lamps substantially intersect at a predetermined location within arms of the "U".

7. The assembly of claim 6 wherein the predetermined location is aligned with a location approximately half way between the eyes of a user when the "U"-shaped housing is attached to a user's protective helmet.

8. The assembly of claim 1 wherein the means for receiving one or more batteries for powering the head lamps is internal to the housing.

9. The assembly of claim 1 wherein the means for receiving the one or more batteries is external to the housing.

10. The assembly of claim 1 further comprising switch means for turning the head lamps on or off and electrically coupling the head lamps to batteries mounted internal to the housing or external to the housing.

11. The assembly of claim 10 further comprising means for connecting an external source of energy so as to charge the batteries internal to the housing.

12. The assembly of claim 11 further comprising regulating means coupled between the means for connecting the external source of energy and the batteries internal to the housing to regulate the charging of the batteries.

13. The assembly of claim 1 wherein the multiple head lamps comprise a first head lamp mounted in the housing so as to project a light beam having a central axis substantially parallel to the major axis and second and third head lamps mounted one on either side of the first head lamp so as to project light beams through the curved front face, wherein the light beams have central axes substantially parallel to a plane formed by the arms and each at an angle in the range of 15–30 degrees with respect to the central axis of the light beam of the first head lamp.

14. The assembly of claim 13 further comprising fourth and fifth head lamps arranged so as to project light beams each having a central axis substantially parallel to the plane and outboard of the light beams of the third and fourth head lamps and at angles with respect thereto in the range of 15–30 degrees.

15. The assembly of claim 1 wherein the U-shaped housing has a substantially :rectangular cross-section in a plane perpendicular to a plane formed by the arms, for housing the reflectors and batteries.

16. The assembly of claim 15 wherein the U-shaped housing is substantially rigid.

17. The assembly of claim 1 wherein the means for receiving the one or more batteries is located in the arms of the "U"-shaped housing.

18. A curved U-shaped helmet light useful for illuminating a user's work space both forwardly and laterally to substantially fill the user's lateral peripheral vision, comprising, a curved U-shaped hollow housing having therein means for retaining one or more batteries and multiple head lamp units, each head lamp unit comprising a reflector and bulb, wherein the head lamp units are spaced around a periphery of the U facing away from arms of the U to project overlapping cones of illumination outwardly from the U so as to provide illumination in a forward direction lying parallel to a principal plane defined by the arms of the U, the forward direction extending outwardly away from a curved portion of the U, and so as to further provide illumination outwardly in directions lying parallel to the principal plane and laterally, angularly displaced with respect to the forward direction by angles in the range of 15–30 degrees between adjacent head lamp units.

19. The light of claim 18 wherein the angles are in the range of 20–25 degrees.

20. A curved assembly for use on a protective helmet to provide illumination enabling a wearer of the helmet to see both forwardly and laterally within the wearer's peripheral vision, comprising, a housing and at least five reflector and bulb bearing lamps contained within and supported by the housing and arranged around an outward facing periphery of the curved assembly and pointing in a direction forwardly and laterally away from the curved assembly, the lamps being oriented so that adjacent cones of illumination produced by the lamps overlap and have central axes angularly displaced from each other by amounts in the range of about 15–30 degrees.

* * * * *